US005125627A

United States Patent [19]

Ipekbayrak et al.

[11] Patent Number: 5,125,627

[45] Date of Patent: Jun. 30, 1992

[54] JACK

[75] Inventors: Selahattin Ipekbayrak, Biedenkopf; Rüdiger Thomas, Haiger; Wolfgang Gröf, Mittenaar-Ballersbach, all of Fed. Rep. of Germany

[73] Assignee: Lahnwerk GmbH & Co. KG, Dautphetal, Fed. Rep. of Germany

[21] Appl. No.: 658,992

[22] Filed: Feb. 21, 1991

[30] Foreign Application Priority Data

Feb. 21, 1990 [DE] Fed. Rep. of Germany ..... 4005447

[51] Int. Cl.[5] ..... B66F 3/12

[52] U.S. Cl. ..... 254/126

[58] Field of Search ..... 254/98, 101, 122, 126, 254/DIG. 4; 269/75

[56] References Cited

U.S. PATENT DOCUMENTS 2,997,762 8/1961 Imparata ..... 254/101

FOREIGN PATENT DOCUMENTS 155084 12/1920 United Kingdom ..... 269/75

2053846 2/1981 United Kingdom ..... 254/126

*Primary Examiner*—Robert C. Watson

*Attorney, Agent, or Firm*—Herbert L. Lerner; Laurence A. Greenberg

[57] ABSTRACT

A jack for a car includes a support column having a middle region and a lower end. A base is articulated at the lower end of the support column and pivotable about a first transverse axis. A support arm is articulated at the middle region of the support column and pivotable about a second transverse axis extending in a given direction. The support arm has a free end with bearing surfaces having a circular segmental cross section. A spindle drive is actuatable by a hand crank for adjusting the free end in height. A load receiver has an open-top channel extending parallel to the given direction for engaging a structural part of a car to be supporting on a jack from below. The load receiver has a lower surface with a bearing extension in the form of a spherical section. A calotte-shaped bearing shell is at least partly congruent with and disposed between the bearing surfaces and the bearing extension for tiltably supporting the load receiver on the bearing surfaces in the form of a ball-and-socket joint. The bearing shell has a lower surface and a middle region with an opening formed therein. A downwardly pointing connecting bolt in the bearing extension has a smaller cross section than the opening and a lower end protruding from the bearing shell with an abutment supported on the lower surface of the bearing shell.

10 Claims, 3 Drawing Sheets

JACK

The invention relates to a jack for a car, including a support column having a lower end to which a base is articulated and pivotable about a transverse axis, and a middle region to which a support arm is articulated and likewise pivotable about a transverse axis, the support arm having a free end being adjustable in height by means of a spindle drive being actuatable by a hand crank, and a load receiver tiltably supported on bearing surfaces of the free end having a circular segmental cross section, the load receiver having a base shaped congruently with the bearing surfaces, and the load receiver having a channel being open at the top and extending parallel to the transverse axis of the support arm for engaging a structural part from below, such as a ridge of a seam between a rocker panel and a floor panel of the car body.

German Patent DE-PS 29 54 496 discloses a jack with such generic characteristics. A substantial number of the characteristics are described in that patent as prior art. In the jack disclosed therein, the base is immovably secured to the lower end of the support column.

In jacks which are also available on the market and are therefore well known, the base is articulated to the support column so as to be movable about a transverse axis.

In the jack of the aforementioned patent, the support arm is constructed as a U-shaped section that is open at the top. In order to bear the load receiver, which is known as a horn, the side elements of the U-shaped section have recesses at the end of the support arm, in the form of bearing surfaces which are formed into the side elements of the section and are themselves in the form of an arc. Each of the surfaces forms a bearing shell with very narrow bearing surfaces.

The so-called horn or load receiver is produced in one piece from a shaped sheet-metal part, which forms a jacket having an arc-shaped cross section, leaving a groove open at the top to serve as a load receiver. In the recesses forming the bearing surfaces of the side elements of the support arm, the horn is supported by its end surface regions in such a way that it is rotatable about its longitudinal axis within a certain circular sector and is secured at the end surface against being loosened from its bearing.

Outwardly or inwardly bent tabs protrude from the jacket of the horn and serve to support a ridge of a seam between the rocker panel and the floor panel of the car body. Shaping the horn serving as the load receiver of the jack in this way is intended to attain the object of furnishing the smallest possible spacing between the load-bearing top of the horn and the transverse axis, about which the horn rotates, in such a jack.

The above-described kind of jack is very simple and inexpensive to manufacture. However, its economy is gained at the cost of some disadvantages which are encountered during use: The jack is introduced with its support column being very highly inclined. In contrast, in the "raised" position, it is substantially steeper. Yet it is supposed to have a secure footing both in the highly inclined introduction position and in the slightly inclined "raised" position. In order to meet those conditions at least somewhat, the base which is secured immovably to the lower end of the support column is provided with two pedestal surfaces, which abut one another at an obtuse angle. One pedestal surface rests flat on the ground in the introduction position of the jack, while the other pedestal surface rests flat on the ground in the "raised" position. During the lifting procedure, the support column tilts from one pedestal surface through the angle edge to the other pedestal surface, so that the jack has an insecure footing while the car is being jacked up.

Another aspect is that the load receiver or horn of the jack is not movable about the transverse axis of the car to be jacked up. When the car is jacked up in the vicinity of a wheel, it is inclined about its transverse axis on the applicable side. Such an inclination can be followed by the jack only by providing for the support column to also be inclined toward the non-jacked-up wheel of the same side of the car, which further impairs the security of the footing of the jack.

Another feature that makes the jack less safe is the way in which the horn is supported. It is supported on the very narrow intersections in the side elements of the U-shaped section making up the support arm.

The result is a high pressure per unit of surface area with which the horn rubs against its bearing surfaces, upon its rotation during the lifting procedure. With frequent use over a relatively long period of time and if rust forms, the jack may become prematurely useless.

Since such a jack is an accessory that is normally rarely used, or not at all, if the owner has a seasonal tire rotation performed by professionals in a garage, it ought to be as inexpensive as possible.

However, on the other hand, a jack that is easy to manipulate and is functionally safe even on difficult ground will pay for itself even if it is rarely used, for instance if the owner has to change a tire while on a trip.

It is accordingly an object of the invention to provide a jack, which overcomes the hereinafore-mentioned disadvantages of the heretofore-known devices of this general type, which on one hand is simple in construction and can be produced inexpensively, yet on the other hand assures great safety in use even if used frequently over a relatively long period of time, and which assures simple manipulation. Particular emphasis is placed on a secure footing of the jack even on uneven ground, in every position during a lifting procedure, and on assuring that the load receiver at the end of the support arm engages the ridge of the seam between the rocker panel and the floor panel, in other words the part intended to be engaged by the jack, without tilting.

With the foregoing and other objects in view there is provided, in accordance with the invention, a jack for a car, comprising a support column having a middle region and a lower end, a base being articulated at the lower end of the support column and pivotable about a first transverse axis, a support arm articulated at the middle region of the support column and pivotable about a second transverse axis extending in a given direction, the support arm having a free end with bearing surfaces having a circular segmental cross section, a spindle drive being actuatable by a hand crank for adjusting the free end in height, a load receiver having an open-top channel extending parallel to the given direction for engaging a structural part of a car, such as a ridge of a seam between a rocker panel and a floor panel of a car body, to be supporting on a jack from below, the load receiver having a lower surface with a bearing extension in the form of a spherical section, a calotte-shaped bearing shell being at least partly congruent with and disposed between the bearing surfaces and the bearing extension for tiltably supporting the load receiver on the bearing surfaces in the form of a ball-and-socket joint, the bearing shell having a lower surface and a middle region with an opening formed therein, and a downwardly pointing connecting bolt in the bearing extension having a smaller cross section than the opening and a lower end protruding from the bearing shell with an abutment supported on the lower surface of the bearing shell.

In accordance with another feature of the invention, the load receiver and the bearing extension together form an integral injection molded plastic part in which the connecting bolt is embedded.

In accordance with a further feature of the invention, the opening in the bearing shell has an oval shape being elongated in a direction along the support arm.

In accordance with a further feature of the invention, the abutment is a metal disk affixed on the end of the connecting bolt and at least laterally engaging edges of the bearing shell at the opening from below.

In accordance with an added feature of the invention, the bearing extension is lined with a sheet-steel, at least partly callote-shaped part.

In accordance with an additional feature of the invention, the bearing shell is a shaped sheet-steel part being welded to the support arm.

In accordance with yet another feature of the invention, the support arm is an open-top U-shaped section with side elements having enlargements, and the bearing shell has a lower part protruding between the side elements and being welded in the enlargements.

In accordance with a concomitant feature of the invention, the support arm is an open-top U-shaped section with side elements having edges, and the bearing shell has at least two opposed peripheral regions with a downwardly curved edge being firmly welded to the edges of the side elements.

The advantage of the articulated connection of the base to the support column, which is known per se, in combination with the ball-and-socket-like connection of the load receiver to the end of the support arm, is that the jack stands firmly and safely during the entire lifting procedure, even on uneven ground. The advantage of the ball-and socket-like construction of the connection of the load receiver to the end of the support arm is that the increasing inclination of the raised side of the car about the transverse axis of the car during the lifting procedure does not impair the security of the footing of the jack or the connection of the load receiver to the part of the car engaged from below.

Since the load receiver is supported over a large surface area at the end of the support arm, friction damage at the contacting surfaces of these two parts is prevented. The oval opening in the bottom of the cup-shaped bearing surface on the support arm assures that the load receiver in its bearing can follow the inclinations of the raised car both about its longitudinal axis and about its transverse axis. As a result, it is always connected in a non-tilting manner with the part of the car being engaged from below, such as the ridge of the seam between the rocker panel and the floor panel.

Other features which are considered as characteristic for the invention are set forth in the appended claims.

Although the invention is illustrated and described herein as embodied in a jack, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
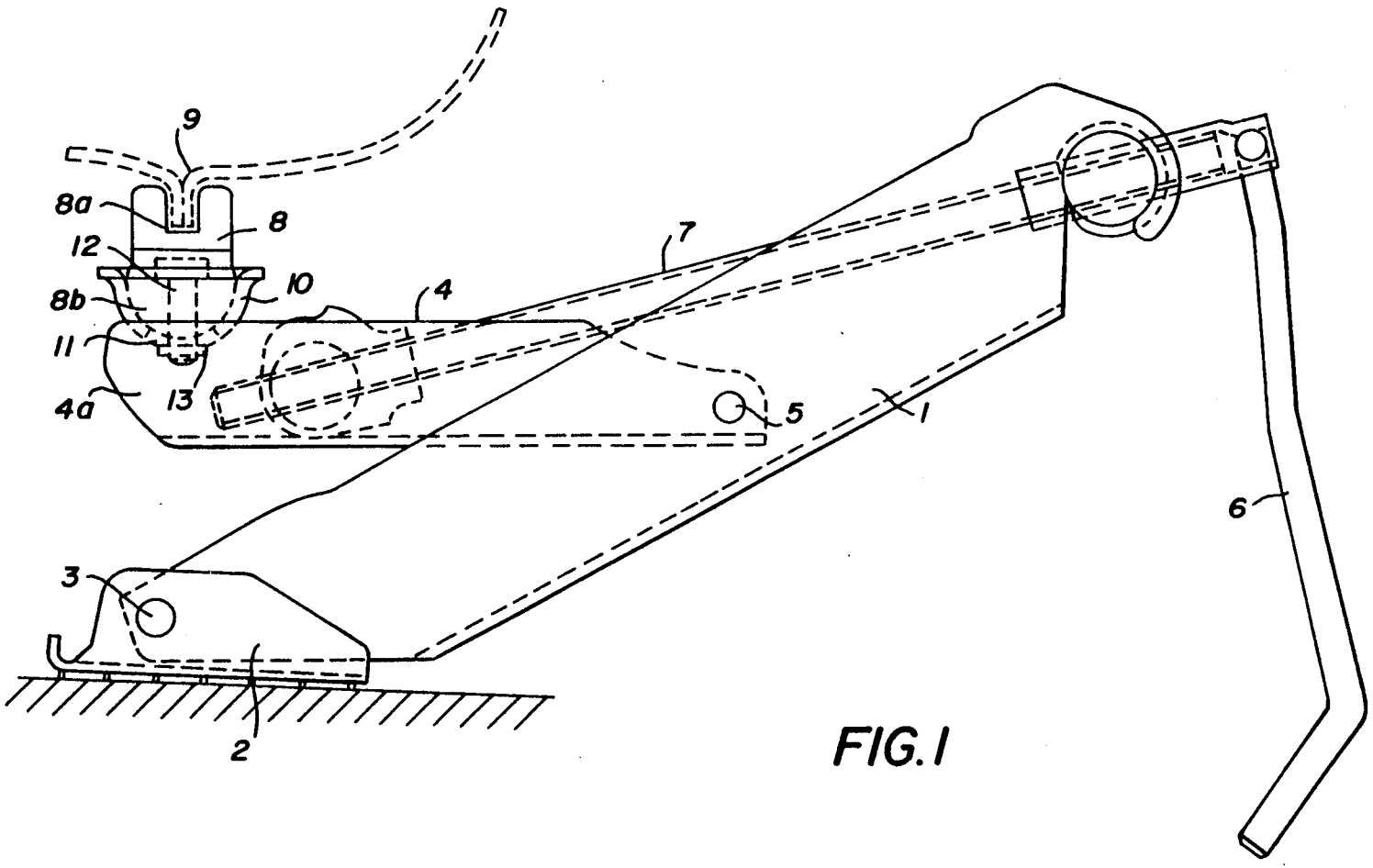
FIG. 1 is a diagrammatic, side-elevational view of a jack according to the invention in a position to begin use.
Figure 2:
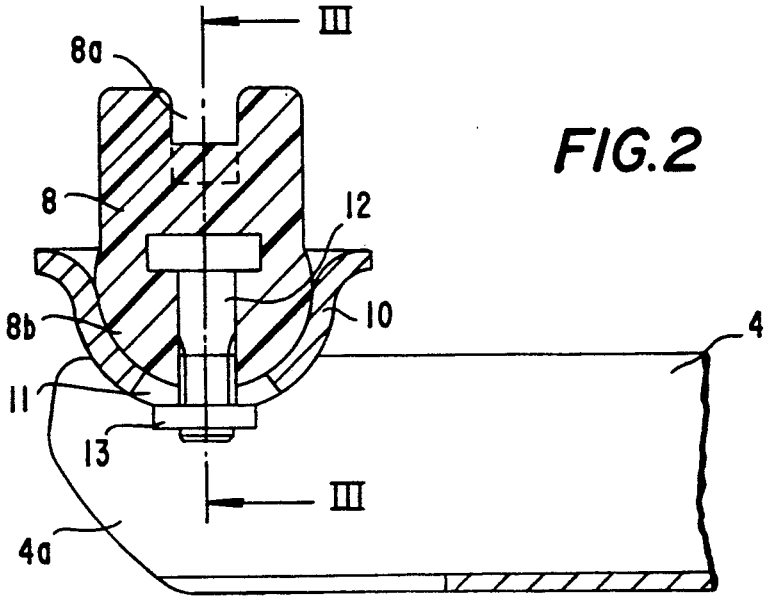
FIG. 2 is a fragmentary, enlarged, longitudinal-sectional view of a free end of a support arm along with a load receiver.
Figure 3:
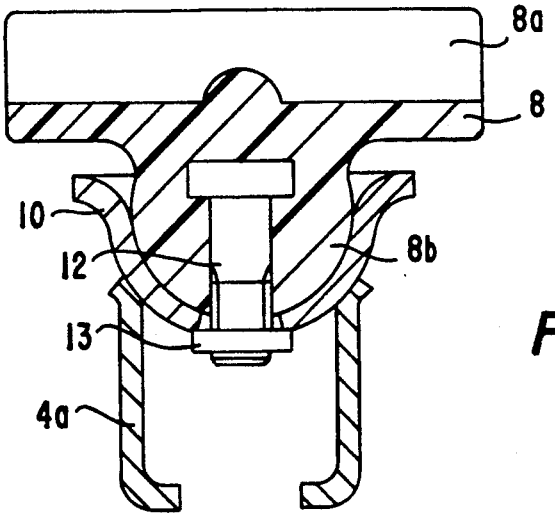
FIG. 3 is a cross-sectional view taken along the line III—III of FIG. 2, in the direction of the arrows.

Referring now to the figures of the drawings in detail and first, particularly, to FIGS. 1-3 thereof, there is seen a jack including a support or support column 1 having a lower end to which a base 2 is articulated, in such a way that it is pivotable about a transverse axis 3, and in a middle region of which a support arm 4 is likewise pivotably articulated about a transverse axis 5. A free end 4*a* of the support arm is adjustable in height by means of a spindle drive 7 that is actuatable by a hand crank 6. A load receiver 8 is secured to the free end 4*a* and in use it engages a structural part of the car to be raised, such as a ridge 9 of a seam between the rocker panel and the floor panel of the car body, which is intended to be supported on a jack from below. The connection of the load receiver 8 to the free end 4*a* of the support arm 4 is constructed in the form of a ball-and-socket joint.

The load receiver 8 is constructed as a plastic injection molded part. The top or upper surface of the load receiver has a transversely extending channel 8*a* therein, in which the structural part of the car which is engaged from below, such as the ridge 9 of the seam between the rocker panel and the floor panel, rests. The bottom or lower surface of the load receiver has a spherical segmental bearing extension 8*b*. The bearing extension rests in a bearing shell 10, which is disposed in bearing surfaces having a circular segmental cross section on the free end 4*a* of the support arm 4 and is in the form of a hemisphere or calotte with a surface that is congruent with a surface of the bearing extension 8*b*. The bearing shell is constructed as a shaped sheet-steel part and is welded to the support arm.

An opening 11 is provided in the middle region of the bearing shell 10, while a connecting bolt 12 that points downward is disposed in the bearing extension 8*b* of the load receiver 8. The cross section of the opening 11 in the bearing shell 10 is larger than the cross section of the connecting bolt 12 and has an oval form extending in the direction of the support arm 4. The end of the connecting bolt 12 protrudes downward out through the opening 11 in the bearing shell 10 and is provided with an abutment 13 in the form of a disk, that is supported on the lower surface of the bearing shell 10 and is fixed to the connecting bolt 12 by clinching or riveting the end of the bolt. The other end of the connecting bolt 12 is embedded in the load receiver and thus is firmly anchored therein.

Figure 4:
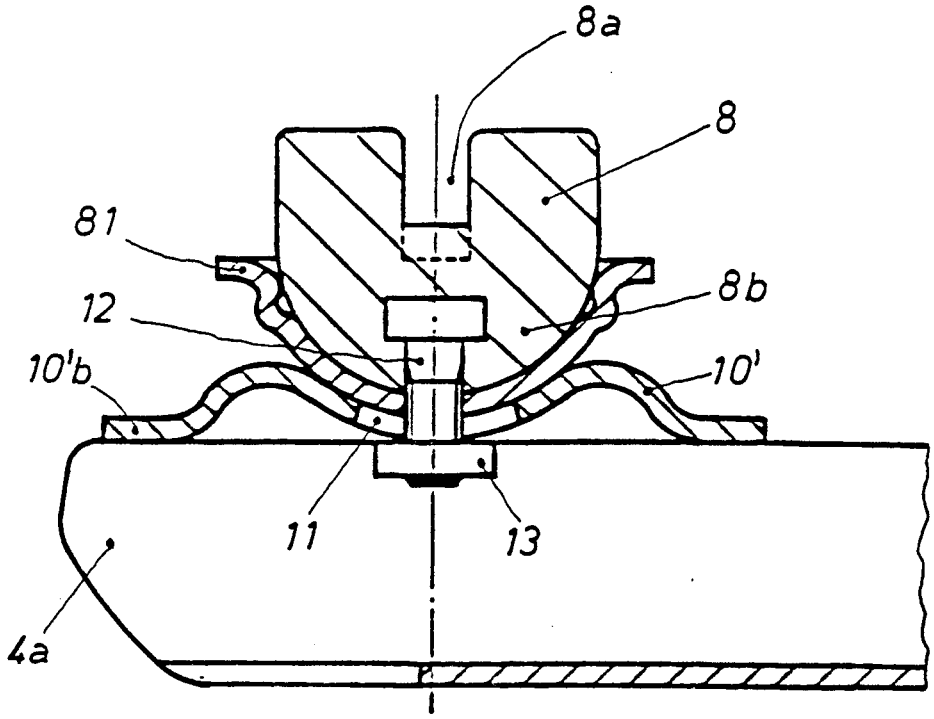
FIG. 4 is a fragmentary, longitudinal-sectional view of the free end of the support arm, with a different version of a bearing and a different embodiment of the load receiver.

While the bearing extension 8*b* rests directly in the bearing shell 10 in the embodiment shown in FIGS. 1-3, in the embodiment shown in FIG. 4 the bearing extension 8*b* of the load receiver 8 is lined with a hemisphere or callote-shaped part 81 that is constructed as a shaped sheet-steel part.

In the embodiment shown in FIGS. 1-3, the lower part of the bearing shell 10 is adequately welded into the support arm 4, which is constructed as a U-shaped section that is open at the top. As is seen in FIG. 3, the lower part of the bearing shell 10 is welded between side elements of the U-shaped section and in bulges or enlargements thereof.

FIG. 4 shows a different embodiment, in which a bearing shell 10' has a downwardly curved edge 10'*b* in two circumferential regions that are opposite one another in the direction of the support arm 4, with which it is firmly welded to the edges of the side elements of the support arm 4, which is constructed as a U-shaped section that is open at the top, like the free end 4*a* shown in FIG. 3.

We claim:

1. A jack for a car, comprising a support column having a middle region and a lower end, a base being articulated at said lower end of said support column and pivotable about a first transverse axis, a support arm articulated at said middle region of said support column and pivotable about a second transverse axis extending in a given direction, said support arm having a free end with bearing surfaces having a circular segmental cross section, a spindle drive being actuatable by a hand crank for adjusting said free end in height, a load receiver having an open-top channel extending parallel to said given direction for engaging a structural part of a car to be supporting on a jack from below, said load receiver having a lower surface with a bearing extension in the form of a spherical section, a calotte-shaped bearing shell being at least partly congruent with and disposed between said bearing surfaces and said bearing extension for tiltably supporting said load receiver on said bearing surfaces in the form of a ball-and-socket joint, said bearing shell having a lower surface and a middle region with an opening formed therein, and a downwardly pointing connecting bolt in said bearing extension having a smaller cross section than said opening and a lower end protruding from said bearing shell with an abutment supported on said lower surface of said bearing shell.

2. The jack according to claim 1, wherein the structural part is a ridge of a seam between a rocker panel and a floor panel of a car body.

3. The jack according to claim 1, wherein said load receiver and said bearing extension together form an integral injection molded plastic part in which said connecting bolt is embedded.

4. The jack according to claims 2, wherein said opening in said bearing shell has an oval shape being elongated in a direction along said support arm.

5. The jack according to claim 1, wherein said abutment is a metal disk affixed on said end of said connecting bolt and at least laterally engaging edges of said bearing shell at said opening from below.

6. The jack according to claim 1, wherein said bearing extension is lined with a sheet-steel, at least partly callote-shaped part.

7. The jack according to claim 1, wherein said bearing shell is a shaped sheet-steel part being welded to said support arm.

8. The jack according to claim 1, wherein said support arm is an open-top U-shaped section with side elements having enlargements, and said bearing shell has a lower part protruding between said side elements and being welded in said enlargements.

9. The jack according to claim 1, wherein said support arm is an open-top U-shaped section with side elements having edges, and said bearing shell has at least two opposed peripheral regions with a downwardly curved edge being firmly welded to said edges of said side elements.

10. A jack for a car, comprising a support, a base articulated on said support, a support arm articulated on said support, said support arm having a free end with bearing surfaces having a circular segmental cross section, means for adjusting said free end in height, a load receiver having an open-top channel for engaging a structural part of a car to be supporting on a jack from below, said load receiver having a lower surface with a bearing extension in the form of a spherical section, a bearing shell having a shape at least partly matching and being disposed between said bearing surfaces and said bearing extension for tiltably supporting said load receiver on said bearing surfaces, said bearing shell having a lower surface and an opening formed therein, and a connecting bolt in said bearing extension having a smaller cross section than said opening and an end protruding from said bearing shell with an abutment supported on said lower surface of said bearing shell.

* * * * *